United States Patent [19]

Cooksley

[11] 4,097,224

[45] Jun. 27, 1978

[54] STEAM GENERATING APPARATUS AND GAS BURNER

[76] Inventor: Ralph D. Cooksley, 346 Barbour Rd., New Britain, Conn. 06053

[21] Appl. No.: 677,178

[22] Filed: Mar. 15, 1976

[51] Int. Cl.[2] ..... F23D 15/02; F23D 13/40

[52] U.S. Cl. ..... 431/352; 431/355; 122/367 C

[58] Field of Search ..... 431/10, 351, 352, 353, 431/278, 279, 280, 281, 284, 285, 191, 355

[56] References Cited

U.S. PATENT DOCUMENTS

| | | | |
|---|---|---|---|
| 1,264,983 | 5/1918 | Seilkop | 431/352 |
| 1,273,284 | 7/1918 | Smith | 431/352 |
| 1,280,214 | 10/1918 | Hansen | 431/352 |
| 1,421,158 | 6/1922 | Brooks | 431/352 |
| 1,458,378 | 6/1923 | Astrom | 431/352 |
| 2,538,953 | 1/1951 | Yates et al. | 431/352 |
| 2,569,514 | 10/1951 | Burklin | 431/355 |
| 2,675,868 | 4/1954 | Ray | 431/352 |

*Primary Examiner*—Kenneth W. Sprague

[57] ABSTRACT

A steam generating apparatus which includes a novel gas burner and consisting of a pair of spaced coaxial cylinders, the outer of which is of considerably greater axial length than the inner and both of which are provided with apertures for admixing the gas with air. The inner cylinder functions as an integral pilot burner which is highly stable. The steam generating apparatus heats water to provide steam, heats it still further, then condenses the steam into liquid to assist in the formation of still more steam.

5 Claims, 6 Drawing Figures

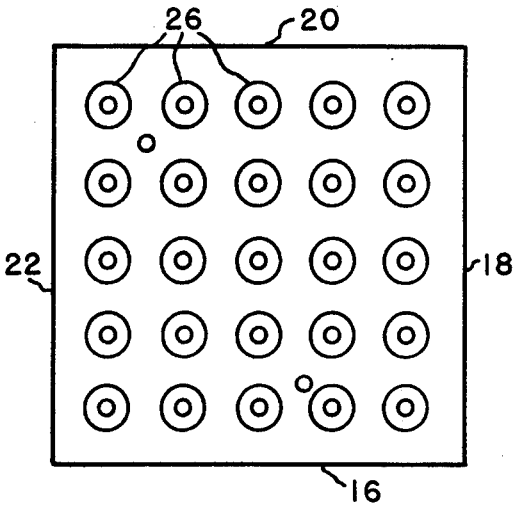
Fig. 2
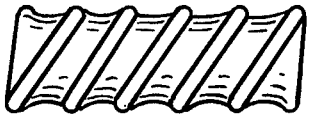
Fig. 3
Fig. 4
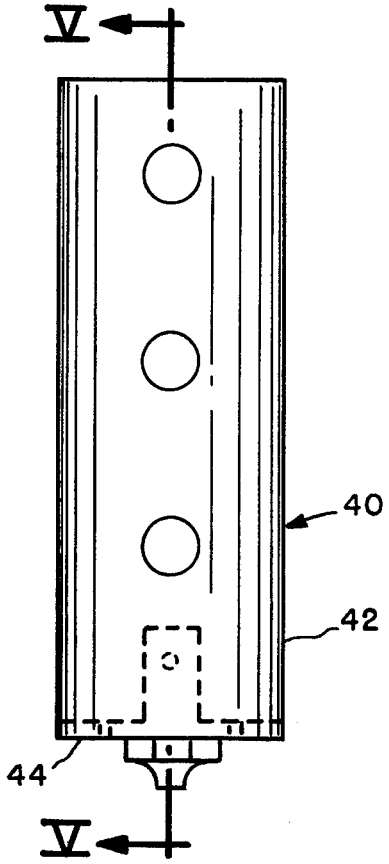

STEAM GENERATING APPARATUS AND GAS BURNER

BACKGROUND OF THE INVENTION

The invention pertains to apparatus for converting a fuel into heat as well as apparatus for utilizing heat to generate steam. In one form the invention pertains to a gas burner. The general recognition of the energy crisis has focused attention on the known differences between the ideal efficiency and the actual efficiency of known apparatus for converting a fuel into heat and apparatus for applying that heat to a quantity of water to generate steam. Stated another way, apparatus having a greater efficiency will have a greater utility. It is apparent that improvements in the efficiency of such apparatus will result in dramatic changes in the total energy requirements when the improved apparatus is widely utilized. An additional problem with the prior art gas burners is that the pilot lights associated therewith require a substantial amount of gas to maintain a strong enough flame to avoid the danger of blowing out the flame. Electric ignition systems for gas burners which have been developed require a substantial initial investment. Existing gas pilot lights have wasted the heat generated by the pilot. The prior art burners have in addition limited the temperature of the flame produced with a given fuel without the use of mixer and blower apparatus. Blower and mixer apparatus is expensive to buy and to maintain.

It is an object of the present invention to provide a novel steam generating apparatus which efficiently utilizes heat energy.

It is another object of the invention to provide a novel burner for gas which will produce higher temperatures than have been possible with the prior art structures without the need for a blower and mixer.

It is another object of the invention to provide a burner construction having an integral pilot light which reduces the possibility of inadvertent pilot light blowout and which consumes a minimum quantity of fuel during pilot light operation.

SUMMARY OF THE INVENTION

The apparatus in one embodiment of the invention includes a gas burner which comprises a base having means for connection to an associated source of a supply and a first sleeve having one end affixed to the base in fluid communication with the means for connection. A second sleeve has a diameter larger than the first sleeve is disposed with one end thereof affixed to the base and having its other end extending coaxially beyond the other end of the first sleeve. Means are provided for holding the first and second sleeves in fixed relationship to provide an annular spacing therebetween extending from the base. Both sleeves are provided with transversely extending apertures therethrough with the apertures of the second sleeve being spaced beyond the other end of the first sleeve, and the base is provided with apertures communicating with the annular spacing between the tubes. The means for connecting may include a restrictor having two generally aligned holes, one of said holes being larger than the other.

The base may be a generally disc-shaped member fixed to the first and second sleeves and disposed with the plane thereof generally at right angles to the axis of the first and second tubes.

Steam generating apparatus in accordance with the invention comprises a first chamber having a bottom surface and a top surface, a plurality of fluid conduits extending between the top and bottom surfaces, a second chamber disposed above said first chamber being in fluid communication with said conduits, means for pumping a fluid from said first chamber into said second chamber and then back into the lower elevational portion of the first chamber, means for conducting fluid from the top of the first chamber through said second chamber to an associated apparatus utilizing steam, and means for generating heat in said conduits. The gas burner may be of the type disclosed herein.

BRIEF DESCRIPTION OF THE DRAWING

The invention will be better understood by reference to the accompanying drawing in which:

FIG. 2 is a sectional view along the line II-II of FIG. 1;

FIG. 3 is an elevational view of an axial section to a larger scale of the twisted tube which is preferably used in the apparatus of FIG. 1;

FIG. 4 is an elevational view of one of the gas burners shown in FIG. 1;

DETAILED DESCRIPTION OF THE PREFERRED EMBODIMENT

Figure 1:
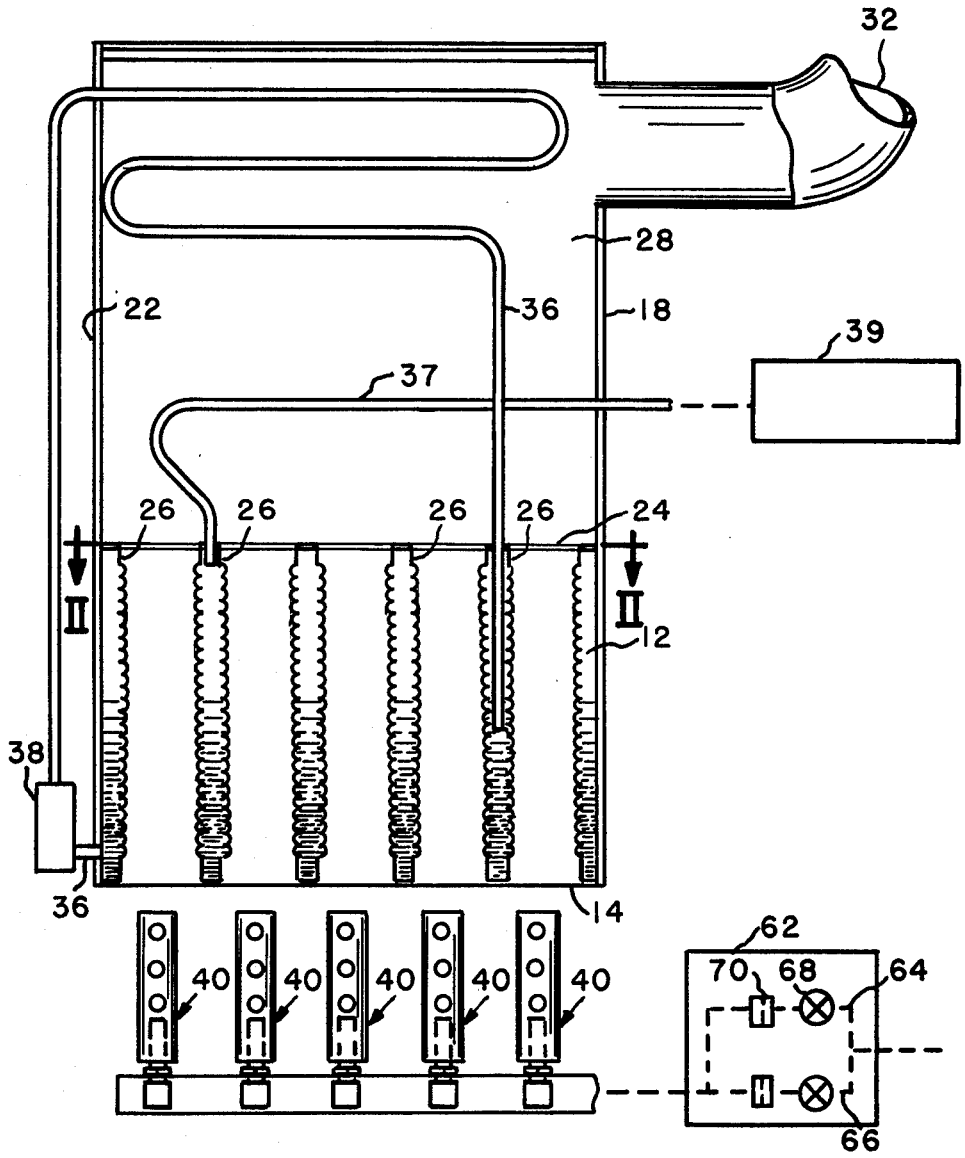
FIG. 1 is a sectional view to a reduced scale taken through a vertical plane of the steam generating apparatus together with a diagrammatic representation of a flow regulating apparatus in accordance with one from of the invention.

Referring now to FIGS. 1 and 2 there is shown a steam generating apparatus 10 in accordance with one form of the invention which includes a first chamber 12 having a floor 14 about which are disposed four upstanding planar walls 16, 18, 20, 22 which are in turn each secured in sealing engagement to a sheet 24. In the preferred form twenty five fluid conduits or twisted tubes 26 extend between the floor 14 and the sheet 24 with the ends thereof the outer surfaces in flush sealing engagements with the floor 14 and sheet 24 to provide fluid communication between the region above the sheet 24 and region below the floor 14 while preventing fluid communication between the interior of the fluid conduits 26 and the interior of the first chamber 12.

Disposed in aligned relationship with the first chamber 12 is a second chamber 28 defined by the sheet 24 and walls 16, 18, 20 and 22 which are co-planar extensions of the walls which surround the first chamber 12. A generally planar top 30 engages each of the walls 16, 18, 20 and 22 in sealing engagement. Extending from the wall 18 of the second chamber 28 in a generally upward direction is an exhaust or vent pipe 32.

It will be understood that the term "twisted tube" as used herein refers to a tubular member having a wall which instead of a generally cylindrical contour has portions thereof raised and particularly raised along a line which follows a helical path about the circumferential extent of the tube. Although less desirable from a technical standpoint, the apparatus in accordance with the invention may use conventional cylindrical tubing which is provided with either a plurality of discrete planar radially estending heat transfer members or a continuous helical radially extending heat transfer member. It will be understood that particularly at some points in the apparatus such as the fluid conduits 26 that a serious compromise in the efficiency of the apparatus will result if other forms are used.

A twisted tube 36 extends out of the first chamber 12 where it communicates with the region of that chamber which is intermediate the twenty-five twisted tubes 26. The tube 36 passes through the wall 22 and connects with the inlet of a pump 38. A twisted tube 36 extends from the outlet of the pump through the wall 22 of the second chamber 22 wherein it traverses the space several times in a generally serpentive fashion before passing through the sheet 24 to the lowermost part of the region of the first chamber 12 which is intermediate the twenty-five twisted tubes 26.

A twisted tube 37 extends from the top of chamber 12, where it is exposed to steam, to a heat exchanger 39 which may be a condenser in a distillation apparatus or merely a baseboard heating unit in a building heating apparatus or various other apparatus which will use steam.

Figure 5:
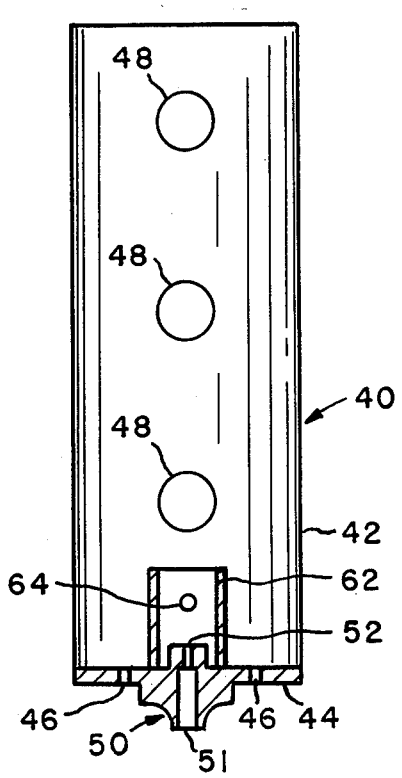
FIG. 5 is a sectional view taken through a vertical plane of the apparatus shown in FIG. 4.
Figure 6:
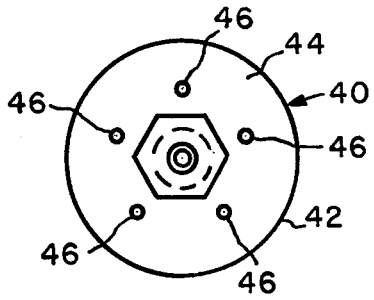
FIG. 6 is a bottom view of the apparatus shown in FIG. 4.

Disposed beneath each of the twenty-five twisted tubes 26 in chamber 12 and below the floor of chamber 12 in generally concentric relationship with the twisted tubes 26 is a plurality of gas burners 40. Each gas burner 40, as best seen in FIGS. 4, 5 and 6, comprises an outer cylindrical sleeve 42 which is open at the top end and closed at the bottom end by means of a disc-shaped member 44. The disc-shaped member 44 in the preferred form is provided with five axially extending holes 46. The outer sleeve 42 is provided with a first axially oriented row of three radially extending holes 48 which have their centers aligned with an imaginary vertical line disposed on the circumference of the outer sleeve 42 as seen in FIG. 4. A second axially oriented row of three holes 42 in the outer sleeve 42 is also provided in the outer sleeve as best seen in the FIG. 5 sectional view. This row of three holes 48 is similarly disposed in aligned relationship to a vertical line which is disposed along the circumference of the outer sleeve 42. It will be understood that the center lines of the two rows of holes referred to are not shown and that the separation between these lines is 180° about the outer sleeve 42. Similarly, two additional rows of three holes 48 are provided which are each disposed with the centers thereof in aligned relationship to lines which are vertical and spaced 90° from each of the previously referred to center lines.

Extending through the disc or disc-shaped member 44 and in sealed engagement therewith is a cylindrical restrictor 50 which comprises a cylinder in which two aligned and communicating bores 51, 52 extend in a generally axial direction. The first bore 51 has a diameter greater than the second bore 52. The purpose of the difference in size of the bores 50, 52 is to facilitate manufacture. Such restrictors ordinarily will be sized with a relatively small diameter hole extending through a cylinder. This may result in breakage of the drills if a single drill is used to produce the entire axial extent of the hole. The problem may be avoided by the use of two separate drills - one which penetrates through the cylinder for an axial portion of the total height of the cylinder and a second which penetrates through the remainder of the axial height in generally aligned relationship to the first. The outer circumference of the cylinder is provided with threads at the lower axial portion for cooperation with piping which is part of a manifold 60 for supplying a combustible gas to each burner 40.

Disposed within the outer sleeve 42 is an inner sleeve 62 of smaller diameter and in generally coaxial relationship so as to provide an annular spacing therebetween. The upper end of the inner sleeve 62 is open and the lower end is disposed in sealing engagement to the disc 44. The holes 46 do not communicate with the interior of the inner sleeve 62. The inner sleeve is provided with a plurality of radially extending holes 64 (one shown). In one form of the invention the number of holes 64 may be twelve. As can be seen, the holes 48 in the outer sleeve 42 are spaced above the open end of the inner sleeve 62.

The manifold 60 is connected to a flow control apparatus 62 which may comprise merely two flow paths 66, 68, one of which comprises a first solenoid valve 68 in series with a relatively small restrictor 70 and the other flow path 68 comprises a second solenoid valve in series with a relatively large restrictor 72. This arrangement willpermit the selective passage of no flow, a small predetermined flow or a relatively large predetermined flow.

In a preferred form the burner outer sleeve 42 has an inside diameter of $\frac{7}{8}$ inch and a length of 4 inches, and the holes 48 have a diameter of  inch. The disc 44 has holes 46 which have a diameter of 3/16 inch and the inner sleeve 62 has an inside diameter of  inch with holes 64 having a diameter of 1/16 inch. The twisted tube 26 has a length of 9 inches. The inside diameter of the hole 52 is 0.050 inch. Testing of alternate lengths of twisted tube 26 of 9 inches has been selected because greater lengths do not achieve appreciably greater temperatures of the outer wall thereof.

In operation of the burners 40, a combustible gas under pressure in the manifold 60 is directed from the flow control apparatus 62 to the restrictor 50 of each burner 40. The manifold 60 as described above is connected to flow control apparatus 62 which can selectively stop all flow of combustible gas into the manifold 60, allow a small predetermined flow rate of combustible gas into the manifold 60 which will be sufficient to enable combustion at the inner sleeves 62 or supply a relatively large predetermined flow of combustible gas to the manifold 60 which will be sufficient to support combustion at both the inner sleeves 62 and the outer sleeves 42 of each burner 40. In some forms of the invention it may be desirable to provide a capability to modulate the quantity of gas flows over two discrete ranges (1) a relatively small range for supporting combustion at the inner sleeves 62 and (2) for the relatively large flows which support combustion at the ends of the outer sleeves 42. Usually, however, the greater simplicity inherent in merely having a predetermined flame size for the pilot light as well as the heating flame, will be preferable. Passage of the relatively small quantity of combustible gas enables the lighting of a flame at the inner sleeve by means of an external flame. Selection of the higher flow rate will automatically initiate burning of the combustible gas at the outer sleeve.

It will be understood that the gas which is burned passes through hole 52 both during pilot and full heating modes of operation. In prior art apparatus attempts to use the same hole to supply the gas for both the pilot light and the main burner have not been successful. If, for example, a flame is initiated at a simple orifice with a relatively small gas flow rate, a sudden increase to a large gas flow rate will blow the flame out.

It has been found that the pilot light provided by the flame at the inner sleeve 62 is highly stable and not vulnerable to being blown out even though a relatively small quantity of combustible gas is utilized to support combustion. This is in contrast to prior art structures which have a discrete pilot light assembly which is disposed in spaced relationship from the primary burners. In order for such a prior art structure to keep the pilot light burning, it is necessary to use a larger quantity of gas to produce a relatively more intense flame. It has also been found that the temperature of the flame produced at the outer sleeve 42 is at least 1000 degrees F when burning natural gas.

During operation of the steam generating apparatus shown in FIGS. 1 and 2 water is initially passed into the first chamber 12 through a fill port (not shown) so that the region in chamber 12 which is intermediate the twenty-five twisted tubes 26 is filled to approximately half of the total height of the first chamber 12. A flame at the outer sleeve 42 of each of the burners 40 extends into the twisted tube 26 which is disposed in generally aligned relationship within the first chamber. Heat is transferred through the walls of the twisted tubes 26 to the water which is disposed in the lower portion of the first chamber 12. The water is circulated by the pump 38 into the second chamber 28 where it is heated still further by the heat from the flames to form steam before it is returned to the first chamber 12 by means of the twisted tube 36. In this manner the heat of vaporization is added to the water within the second chamber 28 and then the steam is returned to the first chamber 12 where the heat of vaporization is used to elevate the temperature of the liquid water present therein. Steam will rise from the surface of the liquid water and pass out through the twisted tube 37 wherein it will be heated still further by the heat from the flame from the burners before passing to the associated steam utilizing device 39. It will be understood that the steam utilizing device 39 may be a condenser for those applications where a distillation process is contemplated or it may be a simple heat exchanger for those applications where the steam is to be utilized for heating such as in a building.

It will thus be seen that the apparatus in accordance with the invention will produce a flame which has a temperature that is considerably higher than the prior art burners, that provides an integral pilot light, and not only has the advantage of relatively low gas consumption and high resistance to blow out, but also has the advantage of having the heat generated by the pilot light being utilized. It will be understood that the heat supplied to the water in the first chamber is used advantageously. It will also be understood that the steam generating apparatus shown in FIG. 1 can produce a greater quantity of steam at a higher temperature for a given quantity of energy from a combustible gas than apparatus previously known. In part this advantage follows from the efficient heat transfer through the twisted tubes. The advantage also follows from the utilization of apparatus which produces steam and then forces that steam back into a body of liquid water to utilize the heat of vaporization to elevate the temperature of that body of water. Although the apparatus functions particularly well with gas fired burners of the type described, it will be understood that more conventional burners may be used which may burn oil or a gas. Other possible variations may include the use of electrical resistance heaters which are disposed within the twisted tubes. It will be understood that the use of the integral pilot light has the advantage of improving the reliability of flame initiation at the main burner with which it is associated since the closeness of the spacing between the pilot light and the main burner is much smaller than the prior art apparatus. It will be understood that, although the integral pilot light is highly effective in initiating a flame at the outer sleeve, the apparatus such as that shown in FIG. 1 may include as few as five burners of the type shown in FIG. 4 since it has been found that the initiation of flame at the outer sleeve of this limited number of burners is sufficient to initiate a flame at a conventional burner having merely a single sleeve which is positioned in the general area such as shown in FIGS. 1 and 2 of the drawing.

Having thus described my invention I claim:

1. A gas burner which comprises a base including means for connection to an associated source of a supply of a fluid fuel, a first tubular sleeve of generally circular cross section having one end affixed to said base in fluid communication with said means for connection, and a second tubular sleeve of generally circular cross section coaxial with said first sleeve and having a diameter large than said first sleeve disposed with one end thereof affixed to said base and having the other end extending beyond the other end of said first sleeve to provide an annular spacing therebetween extending upwardly from said base, each of said sleeves having apertures extending therethrough into the cavity defined therewithin and spaced from said other end thereof, said base having a plurality of axially extending apertures therethrough opening into said annular spacing.

2. The apparatus as described in claim 1 wherein said outer sleeve is provided with a multiplicity of axial rows of apertures spaced equiangularly about the circumference thereof.

3. The apparatus as described in claim 1 wherein each of said apertures in said outer sleeve is disposed at axial points on said outer sleeve spaced beyond said other end of said inner sleeve.

4. The apparatus as described in claim 1 wherein said means for connecting comprises a restrictor having an axial bore therethrough, said bore having a first diameter portion at one end and a larger diameter portion at the other end.

5. The apparatus as described in claim 1 wherein said base comprises a generally disc-shaped member fixed to said first and second sleeves and disposed with the plane thereof generally at right angles to the axis of said first and second sleeves.

* * * * *

UNITED STATES PATENT AND TRADEMARK OFFICE

CERTIFICATE OF CORRECTION

PATENT NO. : 4,097,224

DATED : June 27, 1978

INVENTOR(S) : Ralph D. Cooksley

It is certified that error appears in the above-identified patent and that said Letters Patent are hereby corrected as shown below:

Column 6, line 32, "large" should be "larger"

Signed and Sealed this

*Sixth* Day of *February 1979*

[SEAL]

*Attest:*

RUTH C. MASON
*Attesting Officer*

DONALD W. BANNER
*Commissioner of Patents and Trademarks*